US005927711A

United States Patent [19]

Tsai

[11] Patent Number: 5,927,711

[45] Date of Patent: Jul. 27, 1999

[54] AUTOMATICALLY REPOSITIONABLE OUTPUT STACK RETENTION SYSTEM

[75] Inventor: Margaret P. Tsai, Rochester, N.Y.

[73] Assignee: Xerox Corporation, Stamford, Conn.

[21] Appl. No.: 08/833,877

[22] Filed: Apr. 10, 1997

[51] Int. Cl.[6] ..... B65H 31/36

[52] U.S. Cl. ..... 271/221; 271/3.02; 271/223

[58] Field of Search ..... 271/221, 3.02, 271/223, 224, 233, 241; 414/788.9

[56] References Cited

U.S. PATENT DOCUMENTS 5,534,989 7/1996 Rubscha et al. .
5,549,292 8/1996 Plain ..... 271/292

*Primary Examiner*—Donald P. Walsh
*Assistant Examiner*—Brett Martin

[57] ABSTRACT

In a sheet ejection and stacking system, such as for a document handler output, in which an upper sheet feeding and ejection unit with a sheet ejection path is repositionable between an open and a closed position relative to a lower sheet stacking unit which is providing a sheet stacking tray for the ejected sheets, here a platen cover unit. The sheet stacking tray has an automatically adjusting sheet stacking registration edge wall defining system which is automatically maintained closely adjacent to the sheet ejection position of the upper unit. This system is defined by upstanding stack retaining wall members movably mounted to the sheet stacking tray and a plurality of aligning post members integral the upper unit which automatically engage and move the stack retaining members into alignment with the upper unit, into a proper sheet receiving position therewith, when the upper unit is closed. Yet, the retaining members retain the ejected sheets substantially in their desired stacking position when the upper unit is opened. The aligning post members overlap and mate within the stack retaining members in the closed position to fully block movement of ejected sheets into or under the upper unit. Considerable mounting or other misalignment tolerances are automatically compensated for between the two units with this system.

3 Claims, 3 Drawing Sheets

AUTOMATICALLY REPOSITIONABLE OUTPUT STACK RETENTION SYSTEM

The disclosed embodiment provides improved sheet stacking in a system in which a sheet ejection feeding system is repositionable relative to its sheet stacking area, for access thereto or otherwise, in which an improved sheet stacking registration wall forming system is provided which is mounted in the stacking area but is automatically repositionable for automatic alignment with the repositionable sheet ejection feeding unit and for improved retention of the stacking of sheets in the output area.

The disclosed system, although not limited thereto, is particularly suitable for use in an openable automatic document handler (DH) or other sheet feeding system in which sheets are either stacked in an exit tray or are reversed for duplex operations by reversal of the sheet exit roller nips, where it is desired to fully expose the exit tray by lifting or pivoting away an overlying portion of the DH at times, yet be able to close the DH into operative and properly aligned engagement with the exit tray. This is further shown and described in U.S. Pat. No. 5,534,989, issued Jul. 9, 1996 to the same Margaret Tsai together with Robert F. Rubscha, Attorney Docket No. D/95103; and U.S. Pat. No. 5,549,292, issued Aug. 27, 1996 to the same Margaret Tsai (then Margaret C. Plain), Attorney Docket No. D/94492, both commonly assigned. The present system is fully compatible therewith, as shown in the exemplary embodiment below, and accordingly common connecting or related structures already described in these patents need not be described in detail in this example. The improvements in stacking provided in the present system may be desirably combined with and assisted by a starwheel sheet assistance system associated with the exit nip of the exit rollers as taught in the above-cited U.S. Pat. No. 5,549,292.

As will be seen in this disclosed embodiment, because the stack retainer registration edge (retainer walls) disclosed herein remain in position in the output tray even when the document feeder unit of the DH is lifted up to its open position, the previously stacked paper is prevented from sliding or migrating back under the position of the DH baffle. This prevents the sheets from becoming damaged by, or interfering with, the document feeder unit closure down into its operating position for feeding sheets into the output tray.

As will also be seen in this disclosed embodiment, as the document feeder unit is moved from an open position to its closed position for further feeding of sheets onto the output stack, the adjustable output stack retainers mate with, and are moved by, centering posts on the document feeder unit to ensure correct alignment between the two units and to ensure that the registration edge provided by these adjustable output stack retainers is in the optimum position for receiving further sheets fed by the sheet feeding unit into the tray. This also allows much greater tolerances or variations in module to module manufacturing or alignment errors, to reduce costs and criticality of manufacture and adjustment.

Furthermore, the present system provides a complete, contiguous, uninterrupted barrier between the exit nip of the sheet feed unit and the bottom of the exit tray when the sheet feed unit is closed. Thus, it is impossible for any sheets in the tray to slip or be dragged back inadvertently upstream of the integrated registration wall thus provided.

Although, as noted, this system is shown in this embodiment in the sheet exit and reversal tray of a duplex document handler, it will be appreciated that the concept provided here could also be applied for output trays of the copy sheets outputted from copiers, printers, and/or finisher modules.

A further specific feature of the embodiment disclosed herein is to provide a sheet ejection and stacking system in which an upper sheet feeding and ejection unit with a sheet ejection path is movably mounted to be repositionable between an open and a closed position relative to a lower sheet stacking unit providing a sheet stacking tray for sheets ejected from said sheet ejection path of said upper sheet feeding and ejection unit, the improvement said sheet stacking tray has an automatically adjusting sheet stacking registration edge wall defining system automatically maintained closely adjacent to said sheet ejection path of said upper sheet feeding and ejection unit; said automatically adjusting sheet stacking registration edge wall defining system comprising a spaced plurality of upstanding stack retaining wall members movably mounted to said sheet stacking tray, and a mating plurality of aligning post members integral said upper sheet feeding and ejection unit; said aligning post members and said stack retaining wall members being correspondingly formed to automatically engage one another to move said stack retaining wall members into alignment with said aligning post members upon movement of said upper sheet feeding and ejection unit towards said lower sheet stacking unit.

Further specific features disclosed herein, individually or in combination, include those wherein said upstanding stack retaining wall members have upper openings for receiving said aligning post members internally therein in said closed position, and/or wherein said upstanding stack retaining wall members and said aligning post members overlappingly mate with one another in said closed position to fully block movement of said ejected sheets in said sheet stacking tray from said sheet stacking tray towards said upper sheet feeding and ejection unit.

In reproduction apparatus such as xerographic and other copiers and printers or multifunction machines, it is increasingly important in general to provide faster yet more reliable and more automatic handling of the physical image bearing sheets. It is desirable to more reliably feed and accurately register document and/or copy sheets of a variety and/or mixture of sizes, types, weights, materials, humidity and other conditions, and susceptibility to damage. In the description herein the term "sheet" refers to a usually flimsy physical sheet of paper, plastic, or other suitable conventional physical substrate for images.

As to specific components of the subject apparatus, or alternatives therefore, it will be appreciated that, as is normally the case, some such components are known per se in other apparatus or applications which may be additionally or alternatively used herein, including those from art cited herein. All references cited in this specification, and their references, are incorporated by reference herein where appropriate for appropriate teachings of additional or alternative details, features, and/or technical background. What is well known to those skilled in the art need not be re-described here.

Various of the above-mentioned and further features and advantages will be apparent from the specific apparatus and its operation described in the example below. Thus, the present invention will be better understood from this description, including the drawing figures (approximately to scale) wherein.

Figure 1:
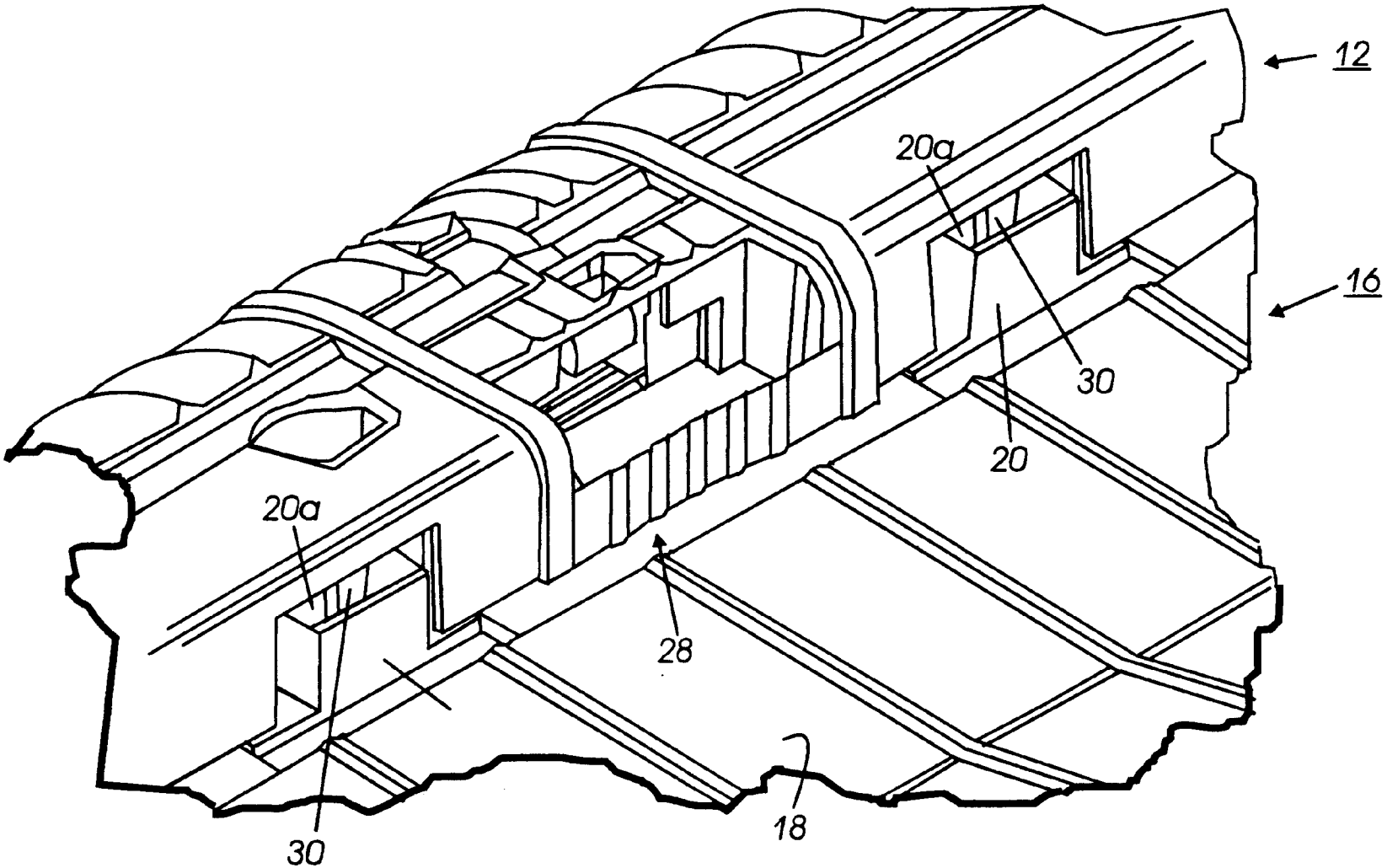
FIG. 1 is a perspective partial frontal view of one embodiment of the disclosed system in its closed or operating position, but with the covers and upper tray of the upper unit removed for illustration clarity.
Figure 2:
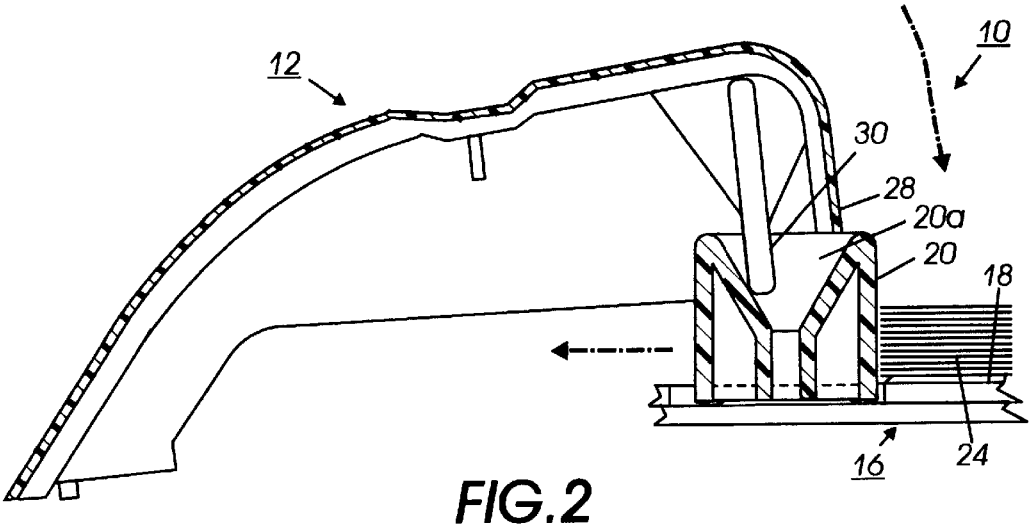
FIG. 2 is an enlarged partial cross-sectional view of key features of the disclosed system of FIG. 1 with the upper unit being closed (moved downwardly into engagement with the lower unit)
Figure 3:
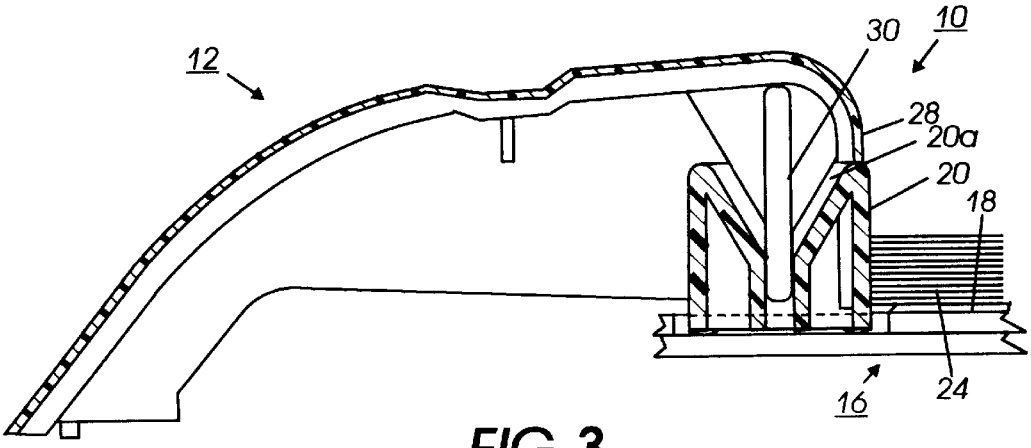
FIG. 3 is the same view as FIG. 2, but in the fully closed or operating position.
Figure 4:
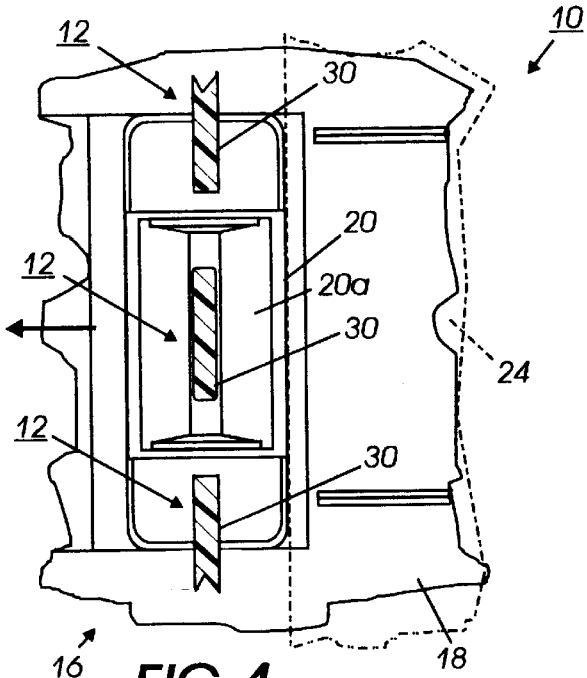
FIG. 4 is a cross-sectional top view of FIG. 3.
Figure 5:
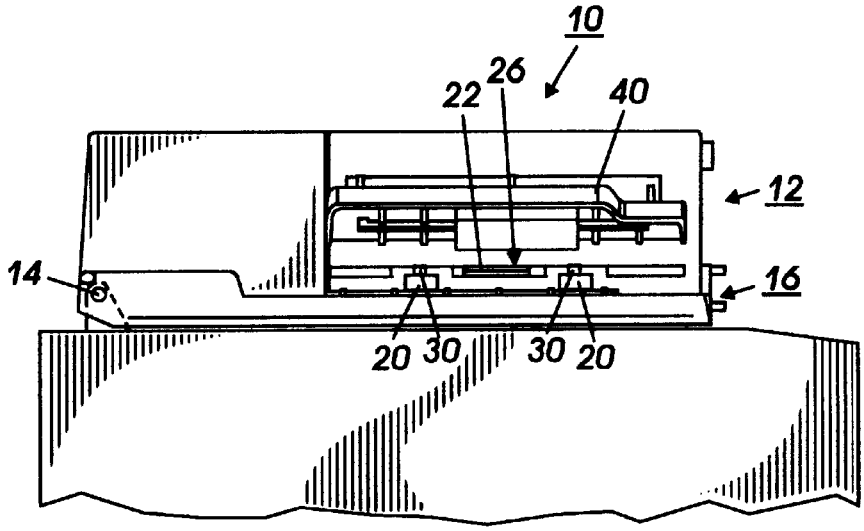
FIG. 5 is a schematic side or end view of the overall document handler example of FIGS. 1–4, in its closed or operating position.
Figure 6:
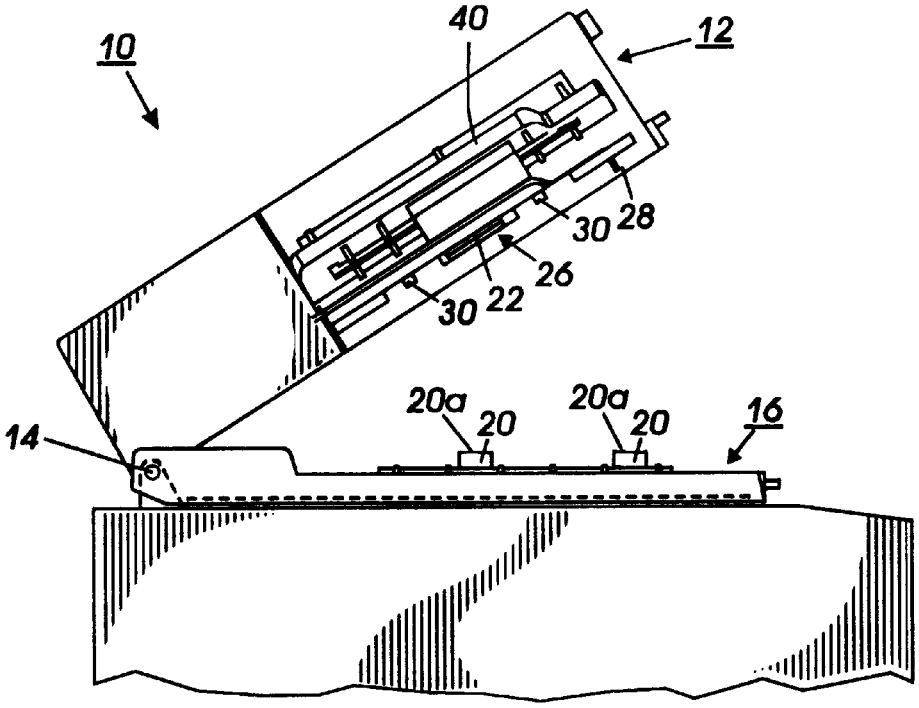
FIG. 6 is the same view as FIG. 5, but in the opened, separated, or jam clearance access position of the upper unit relative to the lower unit.

Shown in the above-described Figures is a particular exemplary document handler (DH) 10, although the invention is not limited thereto. The DH 10 has an upper, sheet feeder, unit 12 mounted about an axis of rotation 14 to be pivotable between an open position and a closed position in relationship to a lower unit 16. (Alternatively, the two units 12 and 16 may be pivotally lifted together.) Here, this lower unit 16 is a platen cover unit which integrally incorporates an output stacking tray 18 in a stacking surface area thereof. The upper unit 12 mounts a document input stacking tray 40, which, in operation, is spaced above but overlying the output stacking tray 18 of the lower unit 16. All of this is described in more detail in the above-cited U.S. Pat. No. 5,534,989 and other patents cited here or therein on this exemplary document handler 10.

It will be particularly noted that here the front or upstream end of the output sheet stacking tray 18 is defined by a pair of automatically adjustable output stack retainers 20. These stack retainers 20 are mounted in tracks so as to be slidable by a small distance, e.g., at least a few millimeters, upstream and downstream in the tray 18, i.e., in the direction of sheet ejection from the upper or sheer feeder unit 12.

The upper or sheet feeder unit 12 has reversible exit rolls 22 through which sheets 24 are ejected from the nip 26 of the exit rolls 22 into the tray 18. Upon reversal of the rolls 22 before a sheet is fully ejected, the sheet is instead fed back into the DH 10 for duplexing, as described in more detail in the above-cited patents. The upper sheet feeder unit 12 also has a front or downstream baffle 28 extending around and extending down from the exit nip 28. However, the baffle 28 cannot insure that no sheet in the tray 18 will not escape thereunder, especially when the upper unit 12 must be lifted up away from the tray 18 for access thereto and/or jam clearance.

It may be seen that here the adjustable stack retainers 20 integral the tray 18 define, and are providing, the front registration or retention wall for the sheets 24 in the sheet stacking tray 18. It can also be seen that these stack retainers 20 are open at the top. That is, they have upper openings 20*a*, and those openings extend downwardly therein with smoothly converging interior surfaces, which are effectively camming surfaces. These openings 20*a* are designed to engage, retain therein, and be repositioned by, posts 30, which posts 30 are fang-like appearing aligning pins integral and extending from the upper, sheet feeder unit 12. At least the outer ends of the posts 30 are much smaller in cross-sectional area than the initial upper openings 20*a* in the stack retainers 20.

As the upper unit 12 is closed down onto the lower unit 16 towards its operating position, the end of each post 30 enters an opening 20*a* of a stack retainer 20. Further movement cause the post 30 to interlock or mate with the stack retainer 20, and also causes automatic alignment by movement of the stack retainer 20 by the post 30 as they mate during this closing. Thus, each stack retainer 20 registration position is self-adjusting and self-aligning, by the post 30 sliding the stack retainer 20 into the correct position with respect to the exit nip 26 and the associated exit nip baffles or walls 28, because the posts 30 are always integral with the baffle 28 and exit nip 26, being extensions of the upper unit 12 and not the lower unit 16.

Thus, the stack retainers 20 are automatically precisely located in the best position for the best stacking in the tray 18 for sheets exiting the nip 26 even though the tray 18 and the sheet exit nip 26 are in two separate units. Also, there is no possibility of the sheets catching on or being obstructed by any baffle or registration wall, since the baffles on the upper sheet feeder unit 12 are fully integrated with the mating stack retainers 20 forming the only stack retaining wall on the lower unit 16. No special manufacturing or user set up or adjustment is required since the stacking wall formed by the two stack retainers 20 is self-adjusting. Furthermore, in the closed position of the upper, sheet feeder, unit 12, the posts 30 thereof are inside of and enclosed by the stack retainers 20. Note however, that the posts 30 need not extend below the lower edge of the baffle 28, and can be spatially integral therewith, being formed in gaps or spaces in the baffle 28. Neither the posts 30 or the lower edge of the baffle 28 need be made or mounted to be either closely or critically spaced from the tray 18 surface. The stack retainers 20 more than bridge that space or gap.

These automatically adjustable stack retainers 20 have other advantages over an alternative of fixed output stack retaining walls molded directly into the stacking tray 18 or otherwise mounted thereon. That would require accurate positioning relative to the exit nip to allow the exiting sheet to descend down onto the stack without obstruction. A fixed registration wall too far into the tray, i.e., too far away from the exit nip, could hold up the sheets, and a registration wall on the tray that was too far upstream and too close to the exit nip would be ineffective for proper or aligned stacking and could interfere with the closing of the upper sheet feeding unit 12, as by direct interference with the exit baffles thereon when attempting to close the upper unit.

While the embodiment disclosed herein is preferred, it will be appreciated from this teaching that various alternatives, modifications, variations or improvements therein may be made by those skilled in the art, which are intended to be encompassed by the following claims.

What is claimed is:

1. In a sheet ejection and stacking system in which an upper sheet feeding and ejection unit with a sheet ejection path is movably mounted to be repositionable between an open and a closed position relative to a lower sheet stacking unit providing a sheet stacking tray for sheets ejected from said sheet ejection path of said upper sheet feeding and ejection unit, the improvement wherein:

said sheet stacking tray has an automatically adjusting sheet stacking registration edge wall defining system automatically maintained closely adjacent to said sheet ejection path of said upper sheet feeding and ejection unit, said automatically adjusting sheet stacking registration edge wall defining system comprising a spaced plurality of upstanding stack retaining wall members movably mounted to said sheet stacking tray, and a mating plurality of aligning post members integral said upper sheet feeding and ejection unit, said aligning post members and said stack retaining wall members being correspondingly formed to automatically engage one another to move said stack retaining wall members into alignment with said aligning post members upon movement of said upper sheet feeding and ejection unit towards said lower sheet stacking unit.

2. The sheet ejection and stacking system of claim 1, wherein said upstanding stack retaining wall members have upper openings for receiving said aligning post members internally therein in said closed position.

3. The sheet ejection and stacking system of claim 1, wherein said upstanding stack retaining wall members and said aligning post members overlappingly mate with one another in said closed position to fully block movement of said ejected sheets in said sheet stacking tray from said sheet stacking tray towards said upper sheet feeding and ejection unit.

* * * * *